US009651228B2

(12) United States Patent
Wang

(10) Patent No.: US 9,651,228 B2
(45) Date of Patent: May 16, 2017

(54) LIGHTING DEVICE FOR HAND TOOL

(71) Applicant: Shih Cheng Wang, Taichung (TW)

(72) Inventor: Shih Cheng Wang, Taichung (TW)

( * ) Notice: Subject to any disclaimer, the term of this patent is extended or adjusted under 35 U.S.C. 154(b) by 42 days.

(21) Appl. No.: 14/792,525

(22) Filed: Jul. 6, 2015

(65) Prior Publication Data

US 2017/0009968 A1 Jan. 12, 2017

(51) Int. Cl.

| | |
|---|---|
| ***F21L 4/00*** | (2006.01) |
| ***F21V 21/088*** | (2006.01) |
| ***B43K 29/10*** | (2006.01) |
| *F21W 131/402* | (2006.01) |

(52) U.S. Cl.

CPC ..... *F21V 21/0885* (2013.01); *B43K 29/10* (2013.01); *F21W 2131/402* (2013.01)

(58) Field of Classification Search

CPC ..... F21V 21/0885; F21V 33/008; F21V 33/0084; B43K 29/10

USPC ..... 362/119

See application file for complete search history.

(56) References Cited

U.S. PATENT DOCUMENTS

| | | | | |
|---|---|---|---|---|
| 5,785,408 | A * | 7/1998 | Tseng | F21L 15/14 362/119 |
| 2011/0176309 | A1* | 7/2011 | Lin | F21L 4/04 362/249.02 |
| 2013/0021787 | A1* | 1/2013 | Noble | F21V 33/0084 362/156 |
| 2013/0182420 | A1* | 7/2013 | Richardson | F21S 9/037 362/183 |
| 2014/0009921 | A1* | 1/2014 | Ancona | F21L 4/005 362/191 |

* cited by examiner

*Primary Examiner* — Anabel Ton

(57) ABSTRACT

A lighting device for a hand tool contains: a base, an illumination unit, and a clamping mechanism. The illumination unit is disposed in the base which includes a lighting orifice and four projections, each two of which are arranged on each of two sides of a bottom end of the base, and between each two projections is defined a V-shaped groove. The clamping mechanism includes a retainer, a connection shaft, and a resilient element, wherein the retainer has a fitting portion, a positioning section, and a controlling section, and wherein the positioning section is placed on the bottom end of the base and is defined among the four projections, the controlling section extends out of one side of the base, and the resilient element is fitted on the connection shaft and has a first end abutting against the base and a second end contacting with the controlling section.

4 Claims, 7 Drawing Sheets

LIGHTING DEVICE FOR HAND TOOL

FIELD OF THE INVENTION

The present invention relates to a lighting device for a hand tool which is clamped on an extension of a hand tool and illuminates the lights.

BACKGROUND OF THE INVENTION

A conventional hand tool is adapted to maintain, assemble or disassemble objects. However, when using the hand tool in a dark environment, a user has to grasp the hand tool with one hand and to hold the hand tool with the other hand, thus operating the hand tool troublesomely.

To improve above-mentioned problem, a screw driver with a lighting device is disclosed in TW Patent No. 056256 and contains a first grip in which a first chamber is defined on a front end of the first grip and a second chamber is formed on a second end of the first grip. The screw driver also contains an extension, one end of which is fitted in the first chamber of the first grip; an electricity storage member disposed in the second chamber of the first grip; a second grip, a lower end of which is rotatably fitted on the first grip, wherein the second grip is rotated relative to the screw driver; a third chamber fixed on a central portion of an upper end of the second grip, and the third chamber including a vision window, an indication direction pointing to a front rim of the extension of the screw driver, and the third chamber also including a power switch fixed on an upper portion of the second grip; an illumination member rotatably mounted in the third chamber of the second grip and illuminating lights to the front rim of the extension of the screw driver. In addition, the illumination member is electrically connected with the electricity storage member via a wire.

Nevertheless, the illumination member is accommodated in the first grip to increase a size of the first grip. In addition, the illumination member is accommodated in the screw driver, so it cannot be fixed on/in another screw driver and cannot be adjusted its position on the screw driver based on using requirement. Even through another illumination member is fitted on an extension of a hand tool in a fixed shape and size.

The present invention has arisen to mitigate and/or obviate the afore-described disadvantages.

SUMMARY OF THE INVENTION

The primary objective of the present invention is to provide a lighting device for a hand tool of the present invention which is clamped on an extension of a hand tool and illuminates the lights.

To obtain the above objective, a lighting device for a hand tool provided by the present invention contains: a base, an illumination unit, and a clamping mechanism.

The illumination unit is disposed in the base, and the base includes a lighting orifice defined on a front end thereof to illuminate lights from the illumination unit, the base also includes four projections, each two of which are arranged on each of two sides of a bottom end of the base, and between each two projections is defined a V-shaped groove.

The clamping mechanism includes a retainer, a connection shaft, and a resilient element, wherein the connection shaft is inserted through two opposite projections on the two sides of the bottom end of the base, the retainer has a fitting portion rotatably connected with the connection shaft, a positioning section formed on a first end thereof away from the fitting portion, and a controlling section arranged on a second end thereof adjacent to the fitting portion, wherein the positioning section is placed on the bottom end of the base and is defined among the four projections, the controlling section extends out of one side of the base, and the resilient element is fitted on the connection shaft and has a first end abutting against the base and a second end contacting with the controlling section.

Preferably, the retainer also has a limiting section vertically extending to the bottom end of the base from the first end of the retainer, and the base further includes a receiving trench formed on a side surface thereof to accommodate the limiting section.

Preferably, the base further includes a first magnetic element disposed on the bottom end thereof, and the retainer has a slot defined on the positioning section to fix a second magnetic element.

Preferably, the positioning section has an arcuate trench defined on a bottom end thereof and connecting with the second magnetic element.

Preferably, the controlling section has a plurality of anti-slip ribs arranged on a bottom end thereof.

DETAILED DESCRIPTION OF THE PREFERRED EMBODIMENTS

Figure 1:
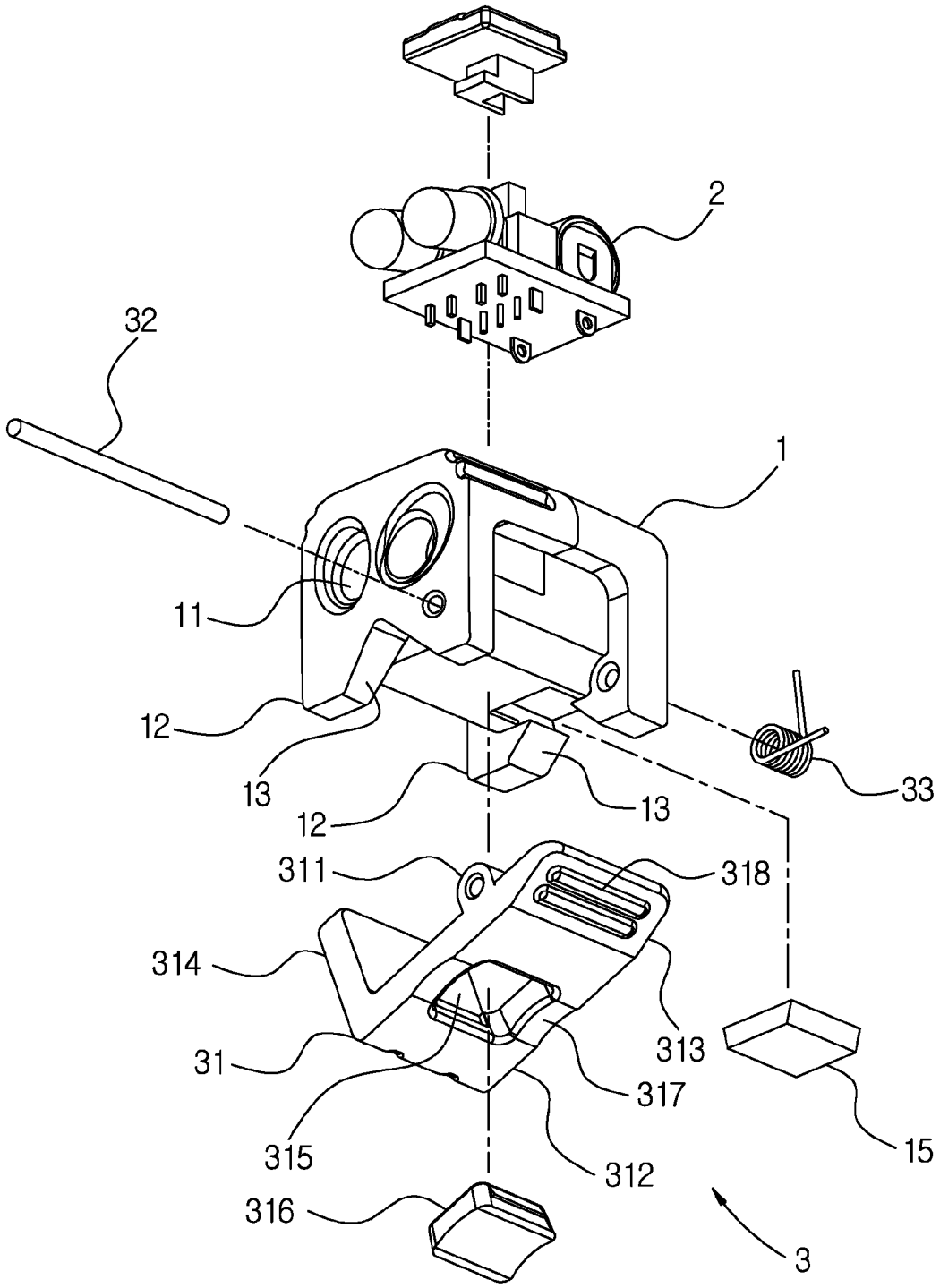
FIG. 1 is a perspective view showing the exploded components of a lighting device for a hand tool according to a preferred embodiment of the present invention.
Figure 2:
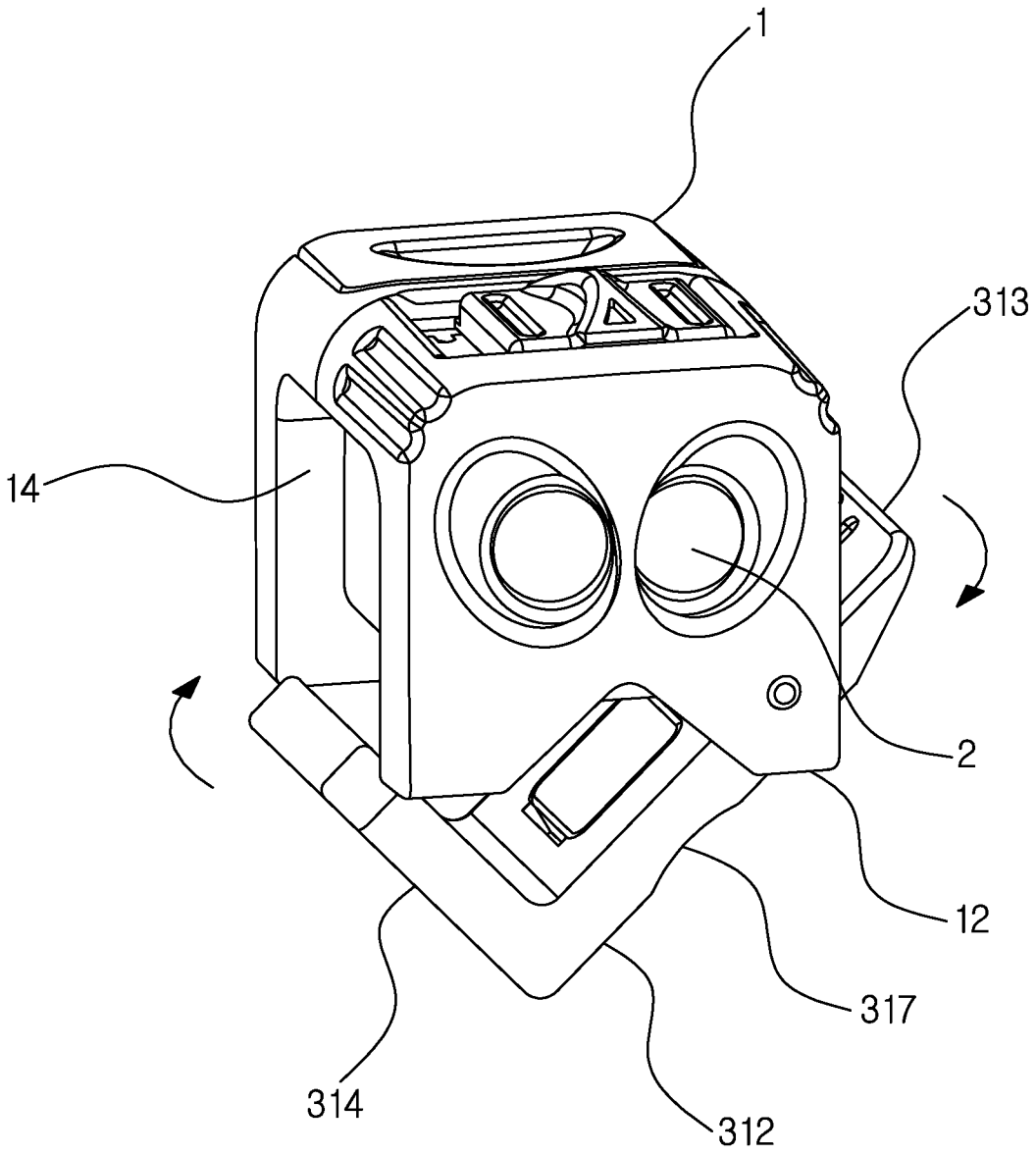
FIG. 2 is a perspective view showing the assembly of the lighting device for the hand tool according to the preferred embodiment of the present invention.

With reference to FIGS. 1 to 4, a lighting device for a hand tool according to a preferred embodiment of the present invention comprises: a base 1, an illumination unit 2, and a clamping mechanism 3.

The illumination unit 2 is disposed in the base 1, and the base 1 includes a lighting orifice 11 defined on a front end thereof to illuminate lights from the illumination unit 2, the base 1 also includes four projections 12, each two of which are arranged on each of two sides of a bottom end of the base 1, and between each two projections 12 is defined a V-shaped groove 13.

The clamping mechanism 3 includes a retainer 31, a connection shaft 32, and a resilient element 33, wherein the connection shaft 32 is inserted through two opposite projections 12 on the two sides of the bottom end of the base 1. The retainer 31 has a fitting portion 311 rotatably connected with the connection shaft 32, a positioning section 312 formed on a first end thereof away from the fitting portion 311, and a controlling section 313 arranged on a second end thereof adjacent to the fitting portion 311, wherein the positioning section 312 is placed on the bottom end of the base 1 and is defined among the four projections 12, the controlling section 313 extends out of one side of the base 1, and the resilient element 33 is fitted on the connection shaft 32 and has a first end abutting against the base 1 and has a second end contacting with the controlling section 313, such that the positioning section 312 abuts against the bottom end of the base 1.

Figure 3:
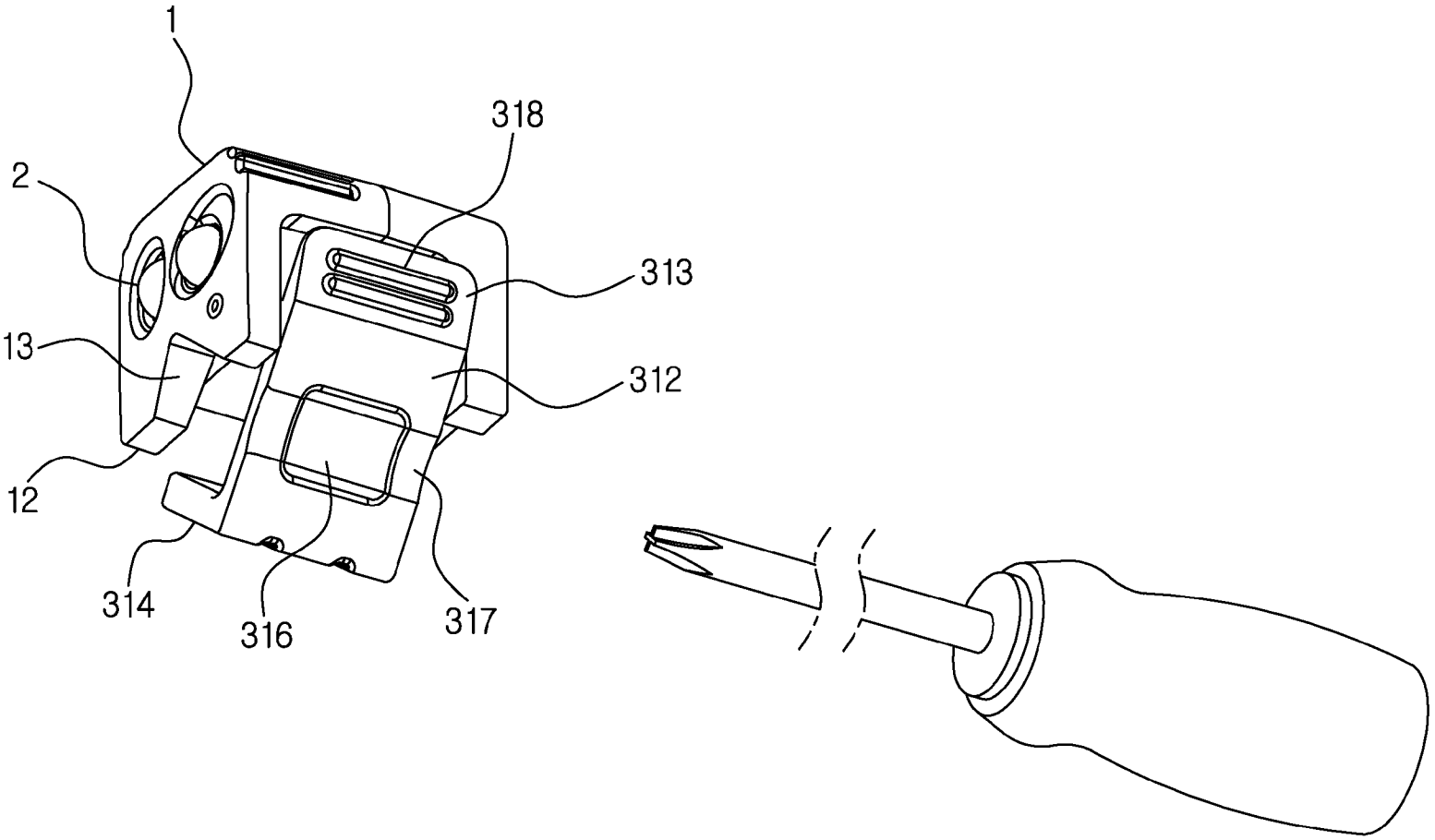
FIG. 3 is a perspective view showing the operation of the lighting device for the hand tool lighting device according to the preferred embodiment of the present invention.
Figure 4:
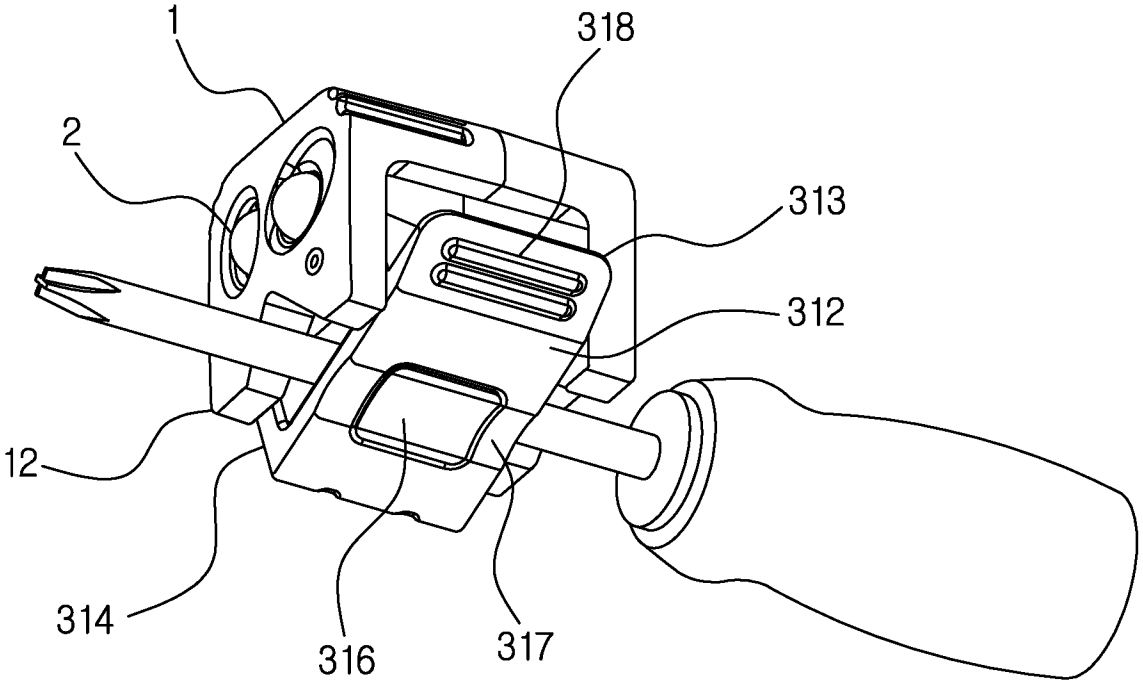
FIG. 4 is another perspective view showing the operation of the lighting device for the hand tool according to the preferred embodiment of the present invention.

In operation, the control section 313 is pressed to rotate the retainer 31, and an edge of the positioning section 312 rotates away from the bottom end of the base 1 to define a fitting space for inserting a hand tool with a small diameter (as shown in FIG. 3), then the controlling section 313 is released, such that the positioning section 312 rotates toward the bottom end of the base 1 to clamp the hand tool between the positioning section 312 and the V-shaped groove 13, and the base 1 is fixed on the tool hand (as illustrated in FIG. 4).

Figure 5:
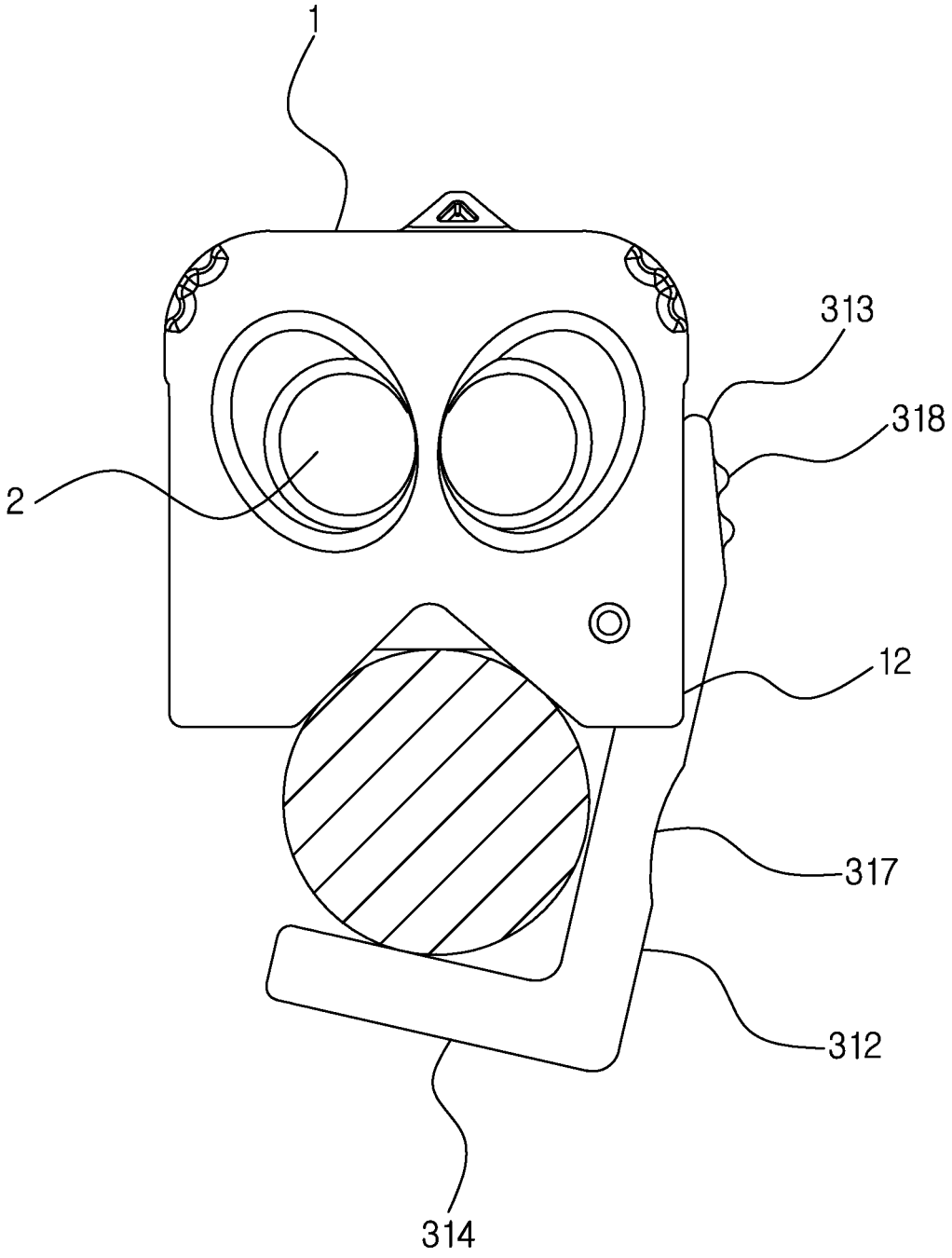
FIG. 5 is a cross sectional view showing the operation of the lighting device for the hand tool according to the preferred embodiment of the present invention.

In addition, the retainer 31 also has a limiting section 314 vertically extending to the bottom end of the base 1 from the first end of the retainer 31, and the base 1 further includes a receiving trench 14 formed on a side surface thereof to accommodate the limiting section 314. Referring to FIG. 5, as desiring to clamp a hand tool with a large diameter by using the retainer 31, the limiting section 314 contacts with the side surface of the base 1, thus clamping the hand tool with the large diameter securely between the limiting section 314 and f the base 1.

The base 1 further includes a first magnetic element 15 disposed on the bottom end thereof, and the retainer 31 has a slot 315 defined on the positioning section 312 to fix a second magnetic element 316, such that when the clamping mechanism 3 clamps the hand tool, the first magnetic element 15 and the second magnetic element 316 magnetically attract an extension of the hand tool which is made of metal material.

Figure 6:
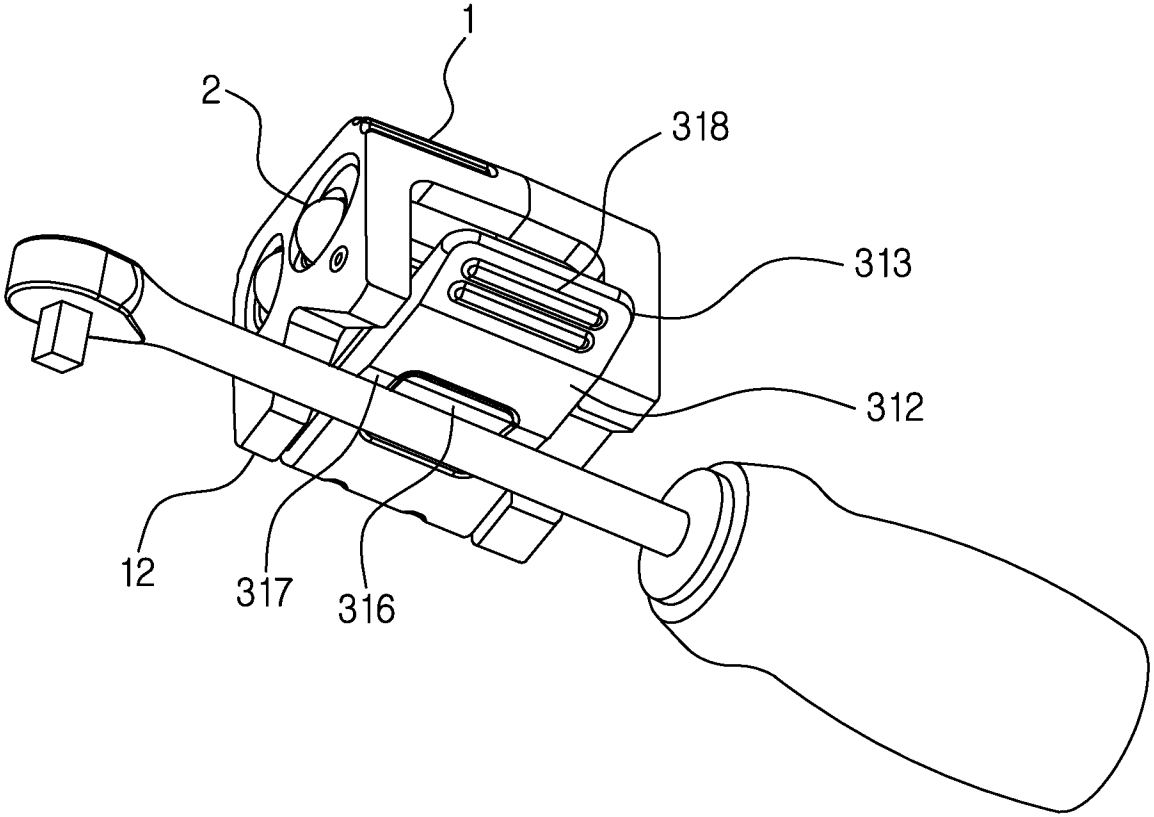
FIG. 6 is a perspective view showing the application of the lighting device for the hand tool according to the preferred embodiment of the present invention.

The positioning section 312 has an arcuate trench 317 defined on a bottom end thereof and connecting with the second magnetic element 316. As shown in FIG. 6, the arcuate trench 317 corresponds to a columnar extension of the hand tool, and the second magnetic element 316 magnetically attracts the hand tool with the columnar extension.

The controlling section 313 has a plurality of anti-slip ribs 318 arranged on a bottom end thereof to enhance friction coefficient as pressing the controlling section 313.

Figure 7:
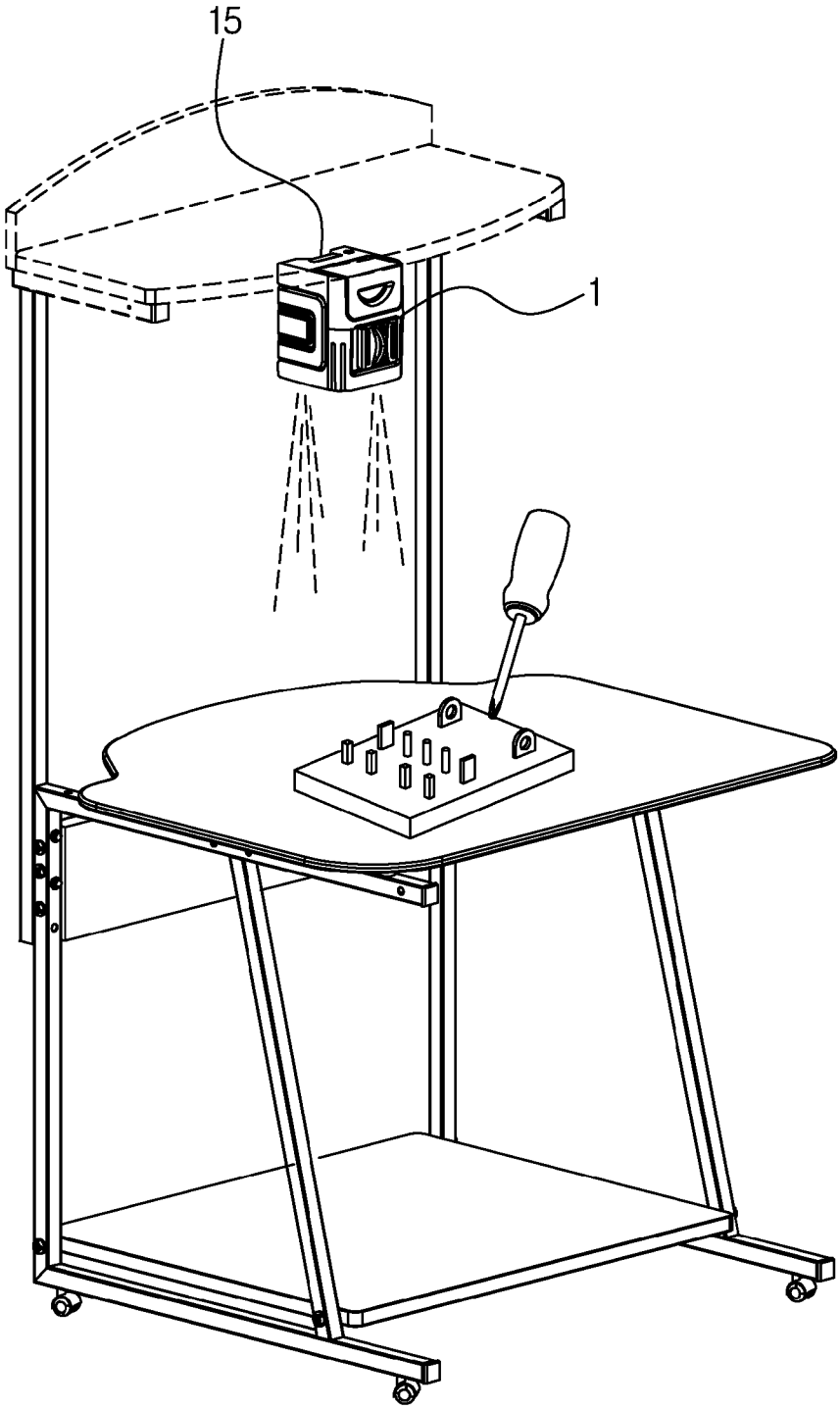
FIG. 7 is another perspective view showing the application of the lighting device for the hand tool according to the preferred embodiment of the present invention.

With reference to FIG. 7, the first magnetic element 15 magnetically attracts on a work table so that the lighting device for the hand tool illuminates a workpiece.

Thereby, the lighting device of the present invention is clamped on the extension of the hand tool and illuminates the lights.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A lighting device for a hand tool comprising:

a base, an illumination unit, and a clamping mechanism, wherein:

the illumination unit is disposed in the base, and the base includes a lighting orifice defined on a front end thereof to illuminate light from the illumination unit, the base also including four projections, each two of which are arranged on each of two sides of a bottom end of the base, and between each two projections is defined a V-shaped groove;

the clamping mechanism includes a retainer, a connection shaft, and a resilient element, wherein the connection shaft is inserted through two opposite projections on the two sides of the bottom end of the base, the retainer has a fitting portion rotatably connected with the connection shaft, a positioning section formed on a first end thereof away from the fitting portion, and a controlling section is arranged on a second end thereof adjacent to the fitting portion, wherein the positioning section is placed on the bottom end of the base and is defined among the four projections, the controlling section extending out of one side of the base, and the resilient element is fitted on the connection shaft and has a first end abutting against the base and a second end contacting with the controlling section; and the base further includes a first magnetic element disposed on the bottom end thereof, and the retainer has a slot defined on the positioning section to fix a second magnetic element.

2. The lighting device for the hand tool as claimed in claim 1, wherein the retainer also has a limiting section vertically extending to the bottom end of the base from the first end of the retainer, and the base further includes a receiving trench formed on a side surface thereof to accommodate the limiting section.

3. The lighting device for the hand tool as claimed in claim 1, wherein the positioning section has an arcuate trench defined on a bottom end thereof and connecting with the second magnetic element.

4. The lighting device for the hand tool as claimed in claim 1, wherein the controlling section has a plurality of anti-slip ribs arranged on a bottom end thereof.

* * * * *